US006651300B1

(12) United States Patent
Müller

(10) Patent No.: US 6,651,300 B1
(45) Date of Patent: Nov. 25, 2003

(54) CLINCHING DEVICE WITH MOVABLE LEVER

(75) Inventor: Rudolf Müller, Frankfurt (DE)

(73) Assignee: Dalex-Werke Niepenberg GmbH & Co. KG, Wissen (DE)

( * ) Notice: Subject to any disclaimer, the term of this patent is extended or adjusted under 35 U.S.C. 154(b) by 0 days.

(21) Appl. No.: 09/806,073

(22) PCT Filed: Sep. 10, 1999

(86) PCT No.: PCT/EP99/06678

§ 371 (c)(1),
(2), (4) Date: May 11, 2001

(87) PCT Pub. No.: WO00/16928

PCT Pub. Date: Mar. 30, 2000

(30) Foreign Application Priority Data

Sep. 24, 1998 (DE) ..... 198 43 834

(51) Int. Cl.[7] ..... B23P 11/00; B23P 19/04; B21D 39/00; B21J 5/00

(52) U.S. Cl. ..... 29/243.5; 29/238; 29/522.1; 29/521; 72/354.2

(58) Field of Search ..... 29/522.1, 521, 29/243.5, 798, 432, 432.1, 432.2, 509, 238, 283.5; 72/395, 396, 470, 353.06, 354; 403/274, 93

(56) References Cited

U.S. PATENT DOCUMENTS 5,230,136 A 7/1993 Cronn et al.

FOREIGN PATENT DOCUMENTS

| | | | |
|---|---|---|---|
| DE | 3923182 | | 1/1991 |
| DE | 4431849 | * | 3/1996 |
| GB | 2069394 | | 8/1981 |
| GB | 2189175 | | 10/1987 |

* cited by examiner

*Primary Examiner*—John C. Hong
(74) *Attorney, Agent, or Firm*—Friedrich Kueffner

(57) ABSTRACT

A clenching device for generating a clenching connection between a first workpiece and a second workpiece using a plunger which is movable from above into a recess of a die, wherein a peripheral wall of the recess has stationary wall sections which extend essentially parallel to a pressure direction. The peripheral wall of the recess has between the stationary wall sections movable wall sections which are arranged on levers. The levers are movable by pressures from above into a working position and are securable therein and from undercut areas and are movable by movement of the workpieces after the workpieces have been jointed in the upward direction into a release position in which the undercut areas are completely released.

25 Claims, 8 Drawing Sheets

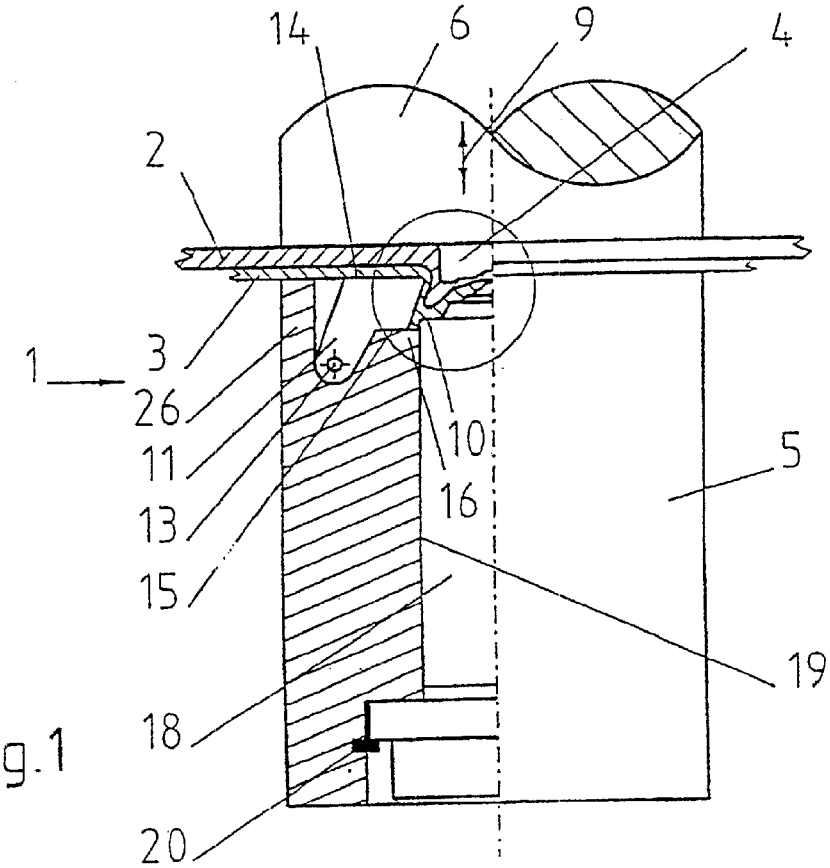
Fig.1
Fig.2
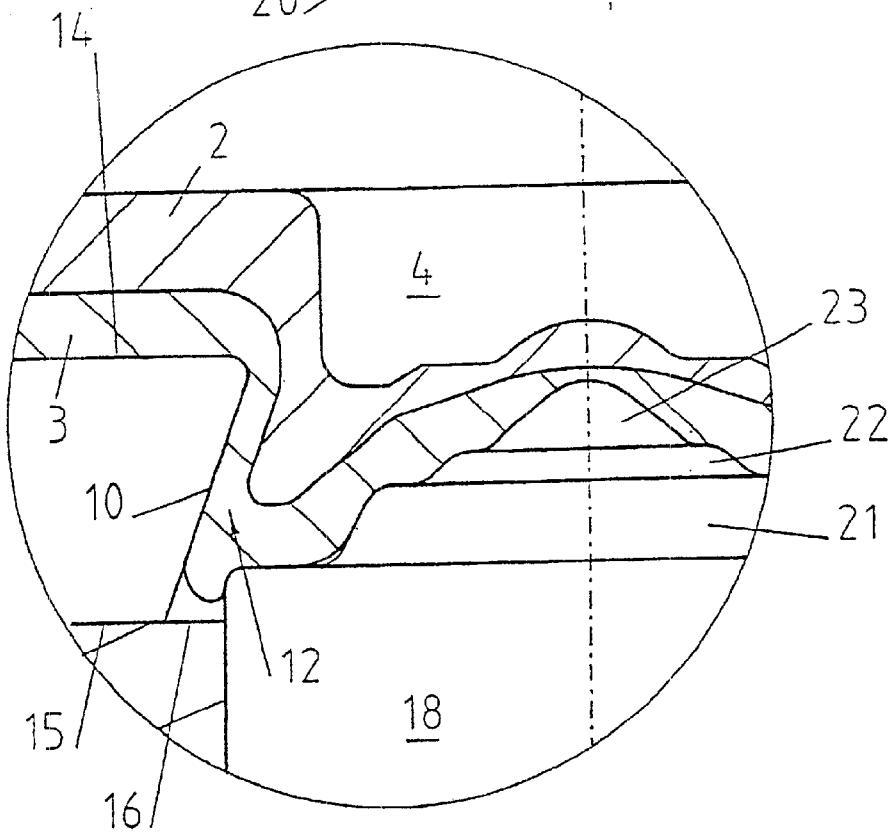

CLINCHING DEVICE WITH MOVABLE LEVER

BACKGROUND OF THE INVENTION

1. Field of the Invention

The invention relates to a jointing device for producing a clinching connection between a first workpiece and a second workpiece by means of a plunger which is insertable from above into the recess of a die whose peripheral wall has stationary wall sections which extends substantially parallel to the pressure direction. Moreover, the invention concerns a clinching method in which a first workpiece and a second workpiece with areal portions are placed atop one another at least with partial overlap and the first workpiece is indented from above such that it is imparted with a cup-shaped formed portion which presses into the second workpiece in the downward direction and deforms the latter without cutting, wherein the formed portion of the first workpiece forms an undercut with the second workpiece limited to predetermined peripheral areas of the formed portion. Finally, the invention relates to a clinching connection wherein a first workpiece has a formed portion which engages a formed portion of a second workpiece and forms with the second workpiece an undercut that is limited to predetermined peripheral areas.

2. Description of the Related Art

Such a clinching device, a clinching method, and a clinching connection are known from U.S. Pat. No. 5,230,136. The die has a cylinder-shaped formed portion from which radial channels extend. A plunger which has a somewhat smaller diameter than the formed portion produces during lowering into two stacked workpieces first a cup-shaped formed portion of the two workpieces wherein in the area of the channels the material of the workpieces can be forced slightly outwardly. By doing so, between the material of the upper workpiece and the material of the lower workpiece a slight undercut can be formed, while the formed portion of the lower workpiece has substantially vertically extending wall sections at the exterior.

In the process of clinching, two workpieces are connected to one another by partial deformation. This can be carried out without supplying heat, which is required, for example, for welding or soldering, and without auxiliary means such as adhesives or auxiliary connecting parts (screws or bolts).

The two workpieces must have areal portions for this purpose which must overlap at least partially with one another and which must rest parallel on one another. It is also possible to connect more than two workpieces with one another. For the subsequent explanation it is assumed that the first and the second workpieces are the outer workpieces. Alternatively, each workpiece can form an undercut with the next workpiece.

In connection with the clinching method, a single step method and a double step method are to be differentiated. In the single step method, the clinching connection is generated in a single working step. In the simplest case, a plunger is lowered into a die. By doing so, cup-shaped formed portions result in the two workpieces and are seated in one another with great friction force. Such a connection has a high shearing resistance but only minimal head-on tensile strength.

In order to increase the head-on tensile strength, dies are used in which, for example, the peripheral wall of the recess is formed by lamellas which are secured with respect to their position by an annular spring, for example, an elastomer ring. When the plunger produces the formed portions and is pressed farther with a sufficiently large force into the die, the two workpieces will deform radially outwardly and will accordingly press the lamellas outwardly so that an undercut of the first workpiece is formed in the second workpiece. In this configuration, the head-on tensile strength is substantially increased. However, the die is a relatively complex component. The lamellas must be manufactured with high precision.

An even better head-on tensile strength results during clinching with a cutting component. For this purpose, two cuts are provided at least in the workpiece facing the die. The other, upper workpiece is then deformed such that it penetrates at least partially the cuts. When applying an even higher pressure, the material is then forced through the cuts to the exterior and forms again an undercut. In this connection it is also required to provide the die with lamellas which are pulled or pressed inwardly by means of a spring force. The clinching connection with cutting component has the advantage of a high head-on tensile strength. However, it has the disadvantage that the workpieces must be cut so that it is no longer possible to provide gas and liquid tightness. This disadvantage can be prevented in that the clinching operation is employed with a reduced cutting component, according to which only the workpiece facing the die is provided with cuts. In both cases, the connection is however generally not suitable for dynamically loaded parts because notch effects result due to the cuts.

In addition to the single step method, two-step clinching methods are known which provide improved head-on tensile properties even without a cutting component. However, in this connection it is necessary to transport the workpieces from one tool to the next or, in reverse, to position a second tool on the required position on the workpiece. Both working steps require a relatively high precision during positioning which makes manipulation more difficult.

DE-A-39 23 182 A1 shows a device for connecting plate-shaped components by means of a die which is comprised of two parts connected at their lower end by a tension spring. The die has at its upper end a recess which conically widens in the downward direction. When a plunger, with interposition of two workpieces, is moved into the die, a clinching connection is produced which has an undercut over its entire periphery, i.e., an undercut between the first and the second workpieces and an undercut on the exterior side. For removing the connected workpieces, it is therefore required to pull apart the two die parts. Since this pulling apart is carried out against the force of the spring, there is the risk that the lower workpiece is scratched or damaged.

GB-A-2 069 394 describes a method for jointing plate-shaped workpieces and a device therefor. The device has a die which is formed by four springy portions which in the peripheral direction adjoin one another and surround a recess. The recess widens conically in the downward direction. In the recess, a counter member to a plunger is arranged which is moved downwardly counter to the force of a spring, when a plunger is moved into the die, with interposition of two workpieces. The movement of the counter member stops shortly before the plunger has reached its greatest stroke. By doing so, the two workpieces are pressed together at the end of the clinching process so that the material is forced radially outwardly in order to form undercuts. When removing the connected workpieces, the portions forming the die must be bent away again. Here, there is also the risk that the connected workpieces will become scratched or will be damaged in other ways.

DE-A-44 31 849 describes a clinching method and a clinching tool in which the plunger elements and die elements are arranged on oppositely positioned and synchronously rotating wheels. This allows to produce clinching connections in a continuous process.

SUMMARY OF THE INVENTION

It is an object of the invention to provide durable clinching connections which can be realized in a simple way.

This object is solved for a clinching device of the aforementioned kind in that the peripheral wall of the recess has movable wall sections between the stationary wall sections which moveable wall sections are arranged on levers wherein the levers are moveable by pressure from above into a working position and can be secured therein and form undercut areas and, by movement of the connected workpieces in the upward direction, are moved into a release position in which the undercut areas are completely released.

With such a clinching device one obtains first of all a relatively simple configuration of the die. The terms "top" and "bottom" are to be understood independent of the direction of the force of gravity in space. They are provided only to determine certain directions relative to the die and to the plunger. For the description of the present invention it is presupposed that "top" is the direction from which the plunger will approach the die. The term "bottom" accordingly indicates the opposite direction. By using levers or fingers which are moved by the pressing process itself into their working position and are secured therein, springs or other auxiliary means, which are required to move the die into the closed position required in order to initiate a deformation, are firstly no longer required. At the moment when the two workpieces are placed onto the die and are loaded with pressure, the levers move into their working position. In this working position, they cannot move away because they are secured therein by the workpieces themselves. The undercuts now provide a space into which the material of the two workpieces can flow. Since the material facing the die is pressure-loaded by the material of the other workpiece, not only the material of the lower workpiece flows into the undercut area but it allows also the material of the other workpiece to follow so that the first workpiece forms an undercut with the second workpiece in the sense of a positive-locking hook connection. Usually, for such an undercut, which is also visible at the die side, the removal of the workpiece from the die would present a certain problem. However, according to the invention, this is prevented in that during lifting of the workpiece, more precisely, of the workpieces connected to one another, the lever is pivoted outwardly, i.e., is moved into the release position. When doing so, the lever must not overcome any spring forces which are required usually for its return movement. Accordingly, the removal of the workpieces can be realized with relatively minimal expenditure, for example, by lifting springs or ejectors. An additional advantage is provided in that during removal of the workpieces from the die the levers will not scratch under pressure the underside of the workpieces so that corresponding scratches are substantially avoided. This not only protects the workpiece but also the corresponding contact surfaces of the levers. The clinching connection not only can be produced in a simple manner; it is also very durable and has a head-on tensile strength, shearing strength, torsional strength, and fatigue strength under reversed bending stresses that makes it suitable for automotive construction. The configuration with the movable wall sections and the stationary wall sections which are substantially parallel to the pressure direction has the advantage that the deformation of the two workpieces resulting in the undercuts does not extend uniformly over the entire periphery of the recess of the die. Instead, along the wall of the recess of the die, only individual portions are provided in which an undercut is present. This has, on the one hand, the advantage that the clinching connection has a certain rotational securing action. On the other hand, this has the advantage that the removal, i.e., taking the workpieces out of the die, is simplified. In the wall sections, which extend parallel to the pressure direction, the workpieces can be simply removed from the die in a direction reverse to the pressure direction. Only in the area of the movable wall sections it is required to move the levers outwardly. A further advantage resides in that for the formation of the undercuts more material is available. This makes it possible to enlarge the undercut overlap to the exterior, i.e., perpendicular to the pressure direction. This results from the fact that material can be displaced from the areas with stationary wall sections into the undercuts. For the head-on tensile strength it is generally of greater importance how far the undercuts project radially or perpendicularly relative to the pressure direction than the question how large the undercut areas are in the peripheral direction.

Preferably, the levers have a substantially planar top side which extends in the working position perpendicularly to the pressure direction and is positioned in the same plane as the top side of the die. External to the actual formed portion, with which the clinching connection is produced, the workpiece is thus positioned substantially opposite a continuous and planar surface. External to the actual clinching connection, no markings are thus produced in the surface of the workpieces. Since the levers with their top side form a plane which extends perpendicularly to the pressure direction, pressure peaks on the levers are avoided. The loading is relatively uniform in the working position so that the levers are treated with care and accordingly have a relatively long service life. As long as the levers are not yet in the working position, the different pressure loading ratios are acceptable because only relatively small counter forces act on the levers.

Preferably, each lever is formed as an angled lever. The pressure force which is used for moving and securing the lever in the working position can thus act onto a larger surface area. The leverage is more favorable so that the required forces can be received even with a relatively weakly dimensioned lever.

Preferably, the angled lever has a short arm on which the wall section is arranged and a long arm on which a pivot axis is located. The lever is thus formed in the shape of an L. At the end face of the short leg the wall section is positioned which forms a part of the sidewall of the recess of the die. The forces which act here are introduced via a relatively long lever arm into the pivot axis. When the closing forces now act via a similarly long lever arm, i.e., onto the outer side of the short leg of the "L", a relatively small expenditure provides the desired equilibrium of forces.

The invention operates satisfactorily when two oppositely positioned levers are provided. It is then possible to arrange several clinching connections relatively tightly next to one another. Preferably, at least three levers are however arranged in the peripheral direction of the recess. With three levers, a force distribution in the peripheral direction can be ensured that is uniform and predetermined in all directions.

Preferably, four levers are however provided. This embodiment has advantages with regard to manufacturing-technological considerations. In particular, a certain symmetry can be ensured.

Preferably, the stationary wall sections form at least 50% of the peripheral length of the recess. The undercut areas are thus relatively short with respect to the peripheral direction. Accordingly, only finger-like or ray-like undercut areas result which have a relatively large depth perpendicularly to the pressure direction.

Advantageously, the die has for each of the levers a securing device against falling out. This securing device against falling out has two advantages. On the one hand, when removing the workpieces from the die it is no longer required to pay attention to the levers remaining in the die. They are instead secured by the securing device against falling out. On the other hand, the die can also be used "overhead", i.e., the plunger can be moved against the force of gravity toward the die. This provides a greater flexibility relative to the mounting position when operating the device.

In a preferred embodiment, the securing device against falling out is a nose which acts radially in the direction toward the lever wherein the lever has a notch cooperating with the nose. This takes into account that the securing device against falling out must be active only when the lever is in its release position. In this position the nose engages the notch and prevents a further movement of the lever in the upward direction, i.e., out of the die. When, in contrast thereto, the levers are in their working position, then they are secured therein by the workpieces. The exchange of the levers, which form the wear parts of the die, is relatively simple. The levers (without contact on the workpieces) must be pivoted in their working position and they can be removed from the die when in this position.

Preferably, the nose has at its upper side a guide surface on which the lever glides during its movement. With this embodiment, it is possible that the lever during its movement from the working position into the release position is not only pivoted but also at the same time displaced parallel to the pressure direction. This realizes a larger opening width so that, in turn, the undercut can have a greater depth. This, in turn, results in a higher head-on tensile strength of the connection.

Advantageously, the nose is formed in an insert part. Then it is possible to employ the nose for the purpose of securing the lever in the die in a captive way. For exchanging the levers, it is only required to demount the insert part which is however possible with relatively minimal expenditure.

In an alternative embodiment, the securing device against falling out is a pin which is guided through the die and the lever and which forms a pivot axis. In this case, the levers are also secured in the die in a captive way. For mounting the lever it is only required to insert the levers into the die and to then insert the pin.

Preferably, the recess has a bottom which is arranged at the upper side of a bottom part inserted into the die. The bottom of the die, which is conventionally provided with a certain shaping in order to ensure flowing of the materials of the workpieces into the corresponding edge areas of the recess, is a wear part. The flowing of the materials takes place with considerable friction. The possibility of arranging the bottom on a bottom part which is exchangeable makes it possible to keep the maintenance and service expenditures of the die relatively small. The levers and the bottom which, as mentioned above, form the main wear parts can be exchanged with simple measures. The bottom part can be secured stationarily in the die.

Advantageously, several dies are arranged adjacent to one another on a first support and several plungers are arranged adjacent to one another on a second support with the same division, wherein at least one of the two supports can be moved relative to the other support such that the plungers and the dies will engage one another successively. The same division can be achieved mechanically in that the plungers and dies have the same center spacing relative to one another. However, it can also be achieved by a suitable movement control. With such a device a series of adjacently positioned clinching connections can be produced quasi continuously. The workpieces are guided between the two supports wherein the two supports have an engagement position where the plunger will engage a die. At this location, the clinching connection is then produced. By a further movement of the workpiece and of the supports, the plunger is then removed from the die and the next plunger enters the next die.

In this connection, it is preferred that at least one support is formed as a wheel and the other support is formed with a planar surface. The wheel can then, so to speak, roll on the surface wherein it may also be provided that the wheel has a stationary rotational axis and the support is moved past it.

In an alternative embodiment, both supports can be formed as a wheel. At the surfaces of both wheels plungers or dies are then provided which engage one another successively.

In another especially preferred embodiment, adjacently positioned dies have lever arrangements which differ from one another. Accordingly, the clinching connections produced adjacent to one another have different orientations and/or shapes. This increases the strength of the connection. In particular, with this it can be realized that the connection between the workpieces has an increased loadability in several directions. It is possible to produce framework-like structures which provide a high torsional stiffness to the connected parts.

This is achieved in a preferred embodiment in that the lever arrangements are arranged asymmetrically wherein the lever arrangements of neighboring recesses are rotated relative to one another. By doing so, adjacently positioned clinching connections also are provided with an asymmetric appearance, i.e., they no longer have radial symmetry relative to an axis which is perpendicular to the workpieces. When now clinching connections positioned adjacent to one another are moreover rotated relative to one another, the strength is improved in different directions.

It is especially preferred in this connection that per recess only one lever is provided. This simplifies the configuration of the die considerably.

The object is solved for a method of the aforementioned kind in that the second workpiece is formed with an outer shape having an undercut in the peripheral areas with undercut between the first and the second workpieces.

Several advantages are obtained according to this procedure, as explained above in connection with the device. On the one hand, when producing the clinching connection, a rotational securing action is automatically provided even when the formed portion otherwise is of radial symmetry. By means of the outwardly projecting undercut areas, which do not extend over the entire periphery, a rotational movement of the two parts relative to one another is blocked. It is especially advantageous in this connection that for the manufacture of the undercut areas more material is now available. In other words, the material which is conventionally available over the entire periphery of the formed portion can now be concentrated onto only a few undercut areas. This makes it possible to make the undercuts wider or deeper perpendicularly to the pressure direction with the same amount of material. It was found that the strength of the connection depends to a greater degree on the depth of the undercuts than on the length of the undercuts in the peripheral direction. When the undercuts are thus limited to areas of the peripheral direction and these areas are then designed with greater overlap in the undercut area, the connection is then as a whole strengthened. This achieves, despite a single-step method and without cutting component, connecting qualities which are otherwise achievable only by two-step methods or by clinching methods with a cutting component. However, the connections formed according to the invention are also dynamically loadable.

Preferably, between the peripheral areas on an exterior side of at least one workpiece, wall sections are produced which extend parallel to the pressure direction. This embodiment entails a compromise. On the one hand, the removal from the die, i.e., taking the workpieces out of the die, is still easily possible. In the areas where the outer side extends parallel to the pressure direction no deformation work must be provided any longer in order to remove the workpiece. Only the frictional forces must be overcome. On the other hand, in particular, for at least substantially vertical peripheral walls, the material constellation is such that the optimal flow paths for the two materials of the workpieces into the undercut areas are provided.

Preferably, a closing force is generated during indenting which acts at least onto one tool part and an opening force results during removal of the formed workpieces from the tool part. Accordingly, the method becomes quasi self-controlling. No external means are required any longer for moving the tool part into its working position or for providing an opening of the tool part when removing the workpieces.

Advantageously, three or more undercut peripheral areas are produced. By doing so, a connection that is supported on all sides perpendicular to the pulling force can be achieved.

The object is solved for a clinching connection of the aforementioned kind in that the second workpiece in the area of the undercut with the first workpiece has an outer shape with an undercut.

As discussed above, in this way it is possible to provide an undercut depth, i.e., the depth of the positive-locking hook connection, is greater than previously. The required material for this can originate in the areas in which no undercut is present. By the shaping at the active surfaces of the levers forming the undercuts, the flow properties can be optimized with regard to the workpieces to be connected. The size and the location of the positive-locking hook connection can be optimized and defined by the selection of the predetermined peripheral areas and the undercut depth.

BRIEF DESCRIPTION OF THE DRAWING

The invention will be explained in more detail in the following with the aid of preferred embodiments in connection with the drawing. It is shown in:

FIG. 1 a schematic view of a device for producing a clinching connection, partially in section;

FIG. 2 an enlarged illustration of a detail of FIG. 1;

DESCRIPTION OF THE PREFERRED EMBODIMENTS

Figure 9:
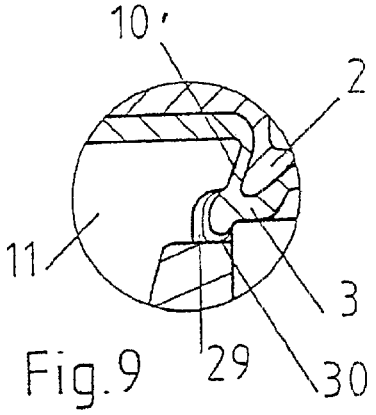
FIG. 9 an alternative embodiment of a limiting surface.

FIG. 1 shows a device for producing a clinching connection between a first workpiece 2 and a second workpiece 3.

The device comprises a plunger 4 and a die 5. The plunger 4 is fastened on a plunger support 6. The plunger support 6 can be moved by means of drive devices (not shown in detail) toward the die 5 such that the plunger 4 can move in the movement direction 9 into a recess 7 (FIG. 3) of the die 5. The recess 7 is essentially of a hollow cylindrical shape, i.e., it has a substantially circular base surface. However, this is not mandatory. Elliptical, oval or polygonal shapes are also possible.

For the following explanation of the device it is presupposed that facing the plunger support 6 is the top side. The directional terms "top" and "bottom" thus correlate with those which result from the illustration according to FIG. 1. However, this does not constitute a limitation. The device 1 according to FIG. 1 can also be operated such that the die 5 is arranged above the plunger support 6 in the direction of the gravitational force.

Figure 3:
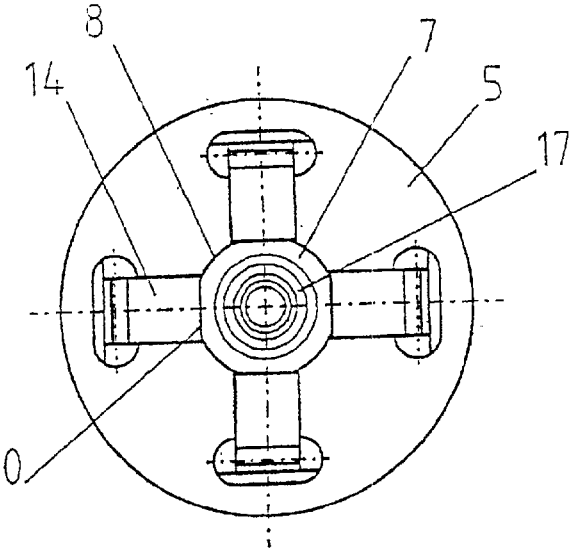
FIG. 3 a plan view onto the die according to FIG. 1.

The die 5 comprises, as mentioned above, a recess 7 which is substantially of a hollow cylindrical shape (FIG. 3). The recess 7 is thus limited in the peripheral direction by stationary wall sections 8 which extend parallel to the movement direction 9, i.e., in accordance with the representation of FIG. 1 they are vertical.

Between the stationary wall sections 8 the recess is delimited by movable wall sections 10 which are arranged at the inner side of L-shaped levers 11. The wall sections 10 are positioned at a slant relative to the movement direction 9. The slant angle to the direction 9 is at least 15°. They open in the downward direction and form accordingly an undercut 12 when the levers are in the working position illustrated in FIG. 1.

The levers 11 are fastened by means of pins 13 in the die 5. The pins 13 form at the same time pivot axes for the levers 11.

Each lever 11 has at its top side a pressure surface 14 which in the working position illustrated in FIG. 1 is flush with the top side of the die 5. The leg which supports the wall sections 10 is positioned with its underside 15 on a projection 16 of the die 5. The lever 11 can thus not be pivoted farther into the interior of the die 5 than allowed by the projection 16.

The recess 7 is delimited in the downward direction by a bottom 17 (FIG. 3) which is arranged at the end face of a bottom support 18. The bottom support 18 is mounted stationarily in the die 5 within a central bore 19. It is secured in the die 5 by means of a clamping ring 20. After releasing the clamping ring 20, the bottom support 18 can be removed from the die 5 in order to exchange it for another.

As can be seen, in particular, in FIG. 2, the bottom 17 has several steps 21, 22 and a rounded tip 23.

For producing a clinching connection the two workpieces 2, 3, which are planar and overlap in this area, are placed onto the top side of the die 5 and are secured by holding-down means, not shown in detail. By placing the workpieces 2, 3, the levers 11 now pivot into the working position illustrated in FIG. 1 if this has not yet been the case. Moreover, the own weight of the workpieces 2, 3 will secure then therein. When the plunger support is now moved in the downward direction and the plunger 4 is lowered into the workpieces 2, 3, the pressure onto the levers 11 increases. They are moved against the projection 16 with a force which is sufficient in order to prevent opening, i.e., pivoting of the levers 11 into the open position, when the material of the two workpieces 2, 3 expands radially outwardly.

FIG. 2 shows how the material of the two workpieces 2, 3 flows. As a result of the tip 23 and of the steps 21, 22, first the material is displaced outwardly away from the radial center of the recess 7. However, already as a result of the pressure of the plunger 4 relative to the die 5 a certain displacement would result. Flowing of the material radially outwardly is enhanced by means of the specially formed portion of the bottom 17. The material of the workpiece 3, which is loaded by means of the material of the workpiece 2, which, in turn, is loaded directly by the plunger 4, can thus flow, where levers 11 are present, into the undercut 12, which is formed by the wall section 10 of the lever. The material of the workpiece 2 follows and thus forms with the second workpiece 3 the desired undercut 24 (FIG. 5).

Figure 4:
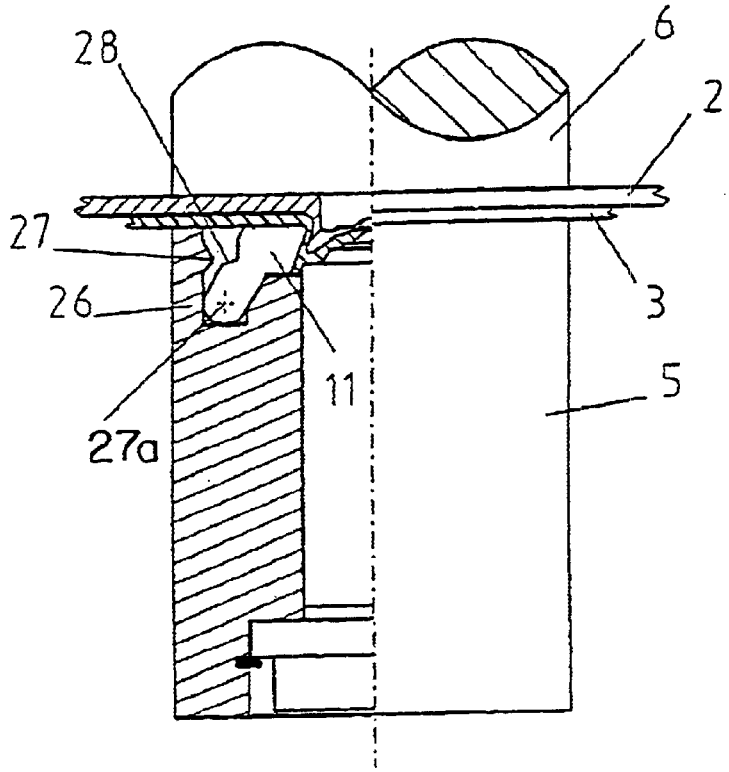
FIG. 4 an alternative embodiment to that of FIG. 1.
Figure 5:
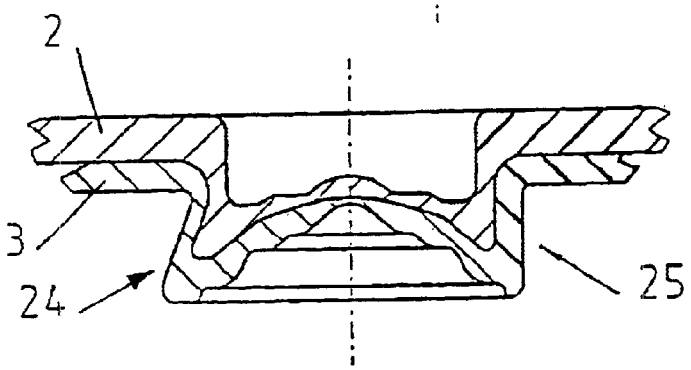
FIG. 5 a section V-V of a clinching connection according to the view of FIG. 6.
Figure 6:
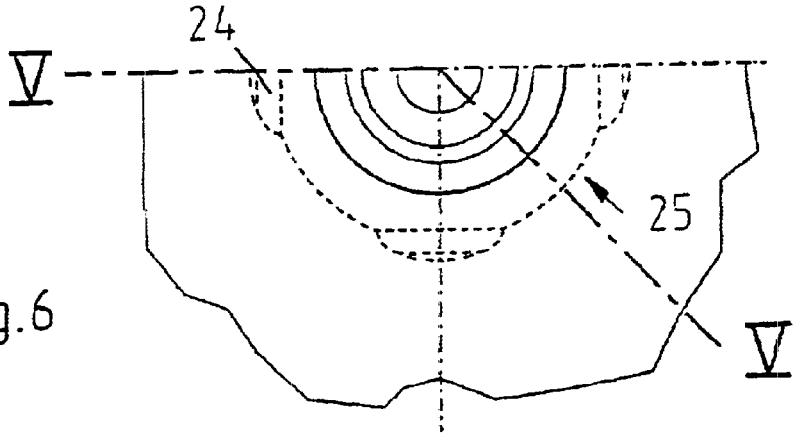
FIG. 6 a plan view onto the connection according to FIG. 5.

As can be seen in FIGS. 5 and 6, this undercut is limited however to only a few undercut areas 24 which are distributed in the peripheral direction. The cross-section of such an undercut area 24 is illustrated in FIG. 4 to the left. The connection illustrated here corresponds to the illustration of FIG. 2, however, without tool.

In the areas where the die has non-movable wall sections 8, the outer shape of the lower workpiece 3 remains instead cylindrical. However, one can observe that material from these cylinder areas 25 has been displaced into the neighboring undercut areas, respectively.

When the clinching connection, as illustrated in FIGS. 5 and 6, is completed, the plunger support 6 can be lifted out of the die 5. FIG. 5 shows that the shape which the plunger 4 has imparted to the workpiece 2 has no undercuts. It is therefore possible without problems to remove the plunger 4 from the workpiece 2.

When the connected workpieces 2, 3 are now lifted out of the die 5, which can be realized either manually or by ejectors, not illustrated in detail, the undercut areas 24 would then normally get caught behind the wall sections 10 and thus prevent a removal of the workpieces 2, 3 from the die 5.

In the present case, the levers 11 however can pivot about the pins 13 when their wall sections 10 are loaded from below, i.e., by the pulling force of the workpieces 2, 3. As a result of the pivot movement, the levers 11 "open" and release the recess 7 so completely that not only the cylinder areas 25 but also the undercut areas 24 are no longer covered in the pulling direction 9 by projecting parts.

In other words, the levers 11 are closed by the workpieces 2, 3 when a pressure is applied, and they are opened by the workpieces 2, 3 when by means of the workpieces 2, 3 a pulling action is applied. When the levers 11 are pivoted into the open position, the undercuts 24 are also free and the workpieces 2, 3 can be removed.

The pins 13 in this context form a securing device against falling out. Too great a pivoting in the opening direction of the levers 11 is prevented by an outer wall 26 of the die 5 on which the levers 11 come to rest when they have reached their widest open release position.

When the workpieces 2, 3 have been removed from the die 5, the levers 11 will fall back into their working position (FIG. 1) as a result of the extra weight provided by the short legs.

When the device 1 is operated in the opposite direction, i.e., the die is positioned above the plunger 4, then the levers 11 remain in the release position until the next workpieces 2, 3 are brought into contact. As soon as the required pressure is applied, the levers 11 pivot again back into their working position. This "closing action" occurs in any case as a result of the force conditions before the deformation of the workpieces 2, 3 by means of the plunger 4 begins.

It is possible to additionally employ in such a clinching connection auxiliary connecting parts, for example, a rivet. The use of such a rivet improves the shearing tension strength considerably while the head-on tensile strength in any case is not impaired. A rivet, which is used as an auxiliary connecting part, can be formed as a massive cylindrical body which in the area of its two axial ends has peripheral beads or projections. The resulting diameter enlargement is however in the range of a few tenths of a millimeter up to approximately one millimeter. At the end faces, the rivet can have a certain conicity. Preferably, it is identical on both ends so that no predetermined orientation must be observed when placing the rivet.

When deforming the workpieces for producing the clinching connection, it is expedient to allow the rivet to project first only slightly from the bottom of the die. Only when the material of the two workpieces 2, 3 has flowed into the respective undercut areas, the rivet, for example, by a second drive process by means of a movable second plunger of the die, is pressed into the bottom of the deformed areas. This results in upsetting of the rivet and, correlated therewith, in a diameter enlargement. In many cases, the material of the workpiece 3 resting against the die, which is already strongly loaded by the preceding deformation, will crack so that the rivet will penetrates this workpiece. Since the other workpiece however remains closed, the connection is still tight.

The dimensions of such a rivet depend on the properties of the used workpieces. In many cases, a diameter of 2 to 3 mm and a length of 3 to 5 mm will be expedient.

The rivet is preferably inserted in the non-movable part of the device, i.e., generally it is inserted on the side of the die. This facilitates supplying because the rivet can then be supplied by means of a stationary guide path. For this purpose, the second plunger can be lowered, for example, to such an extent that it releases an opening to a supply path. For forming the clinching connection, this process is however not mandatory. The rivet or a corresponding auxiliary connecting part can also be supplied via the plunger, i.e., can be inserted from above into the clinching connection.

FIG. 4 shows an altered embodiment in which same parts are identified with same reference numerals.

The change relative to the configuration according to FIG. 1 is only the shape and the attachment of the levers 11. Only a pivot axis lever 11 is no longer fastened by means of a pin 13 in the die 5. It is only placed therein; it can thus not fall out as a result of gravity in the position illustrated in FIG. 4.

The exterior wall 26 of the die has a nose 27 which engages a notch 28 of the lever 11 when the lever 11 is in its release position.

In reality, the engagement is realized already at a prior point in time after a small outward movement of the lever 11 so that the lever 11 also cannot be pulled out upon pulling the workpieces 2, 3 out of the die 5. It will instead be caught on the nose 27.

During an "overhead" operation, the lever 11 remains safely within the die 5. As long as no workpieces 2, 3 rest on the die, the lever 11 is secured by the nose 27 which in this case forms the securing device against falling out. When the workpieces 2, 3 come to rest on the die 5, then they secure the lever 11 against falling out.

Otherwise, the function of the lever 11 as a means for providing a movable wall section 10 is the same as in the embodiment according to FIG. 1.

Figure 7:
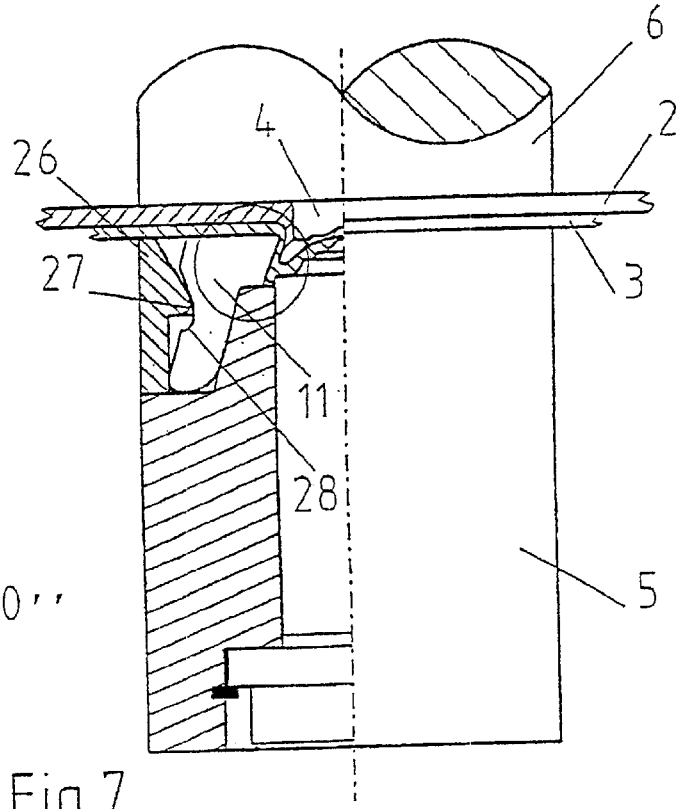
FIG. 7 a third alternative corresponding to the view according to FIG. 1.

FIG. 7 shows a third embodiment in which the same parts are identified with same reference numerals. For a better understanding, FIG. 8 shows the device when the plunger, the connected or jointed workpieces 2, 3, and the die are separated from one another.

Figure 8:
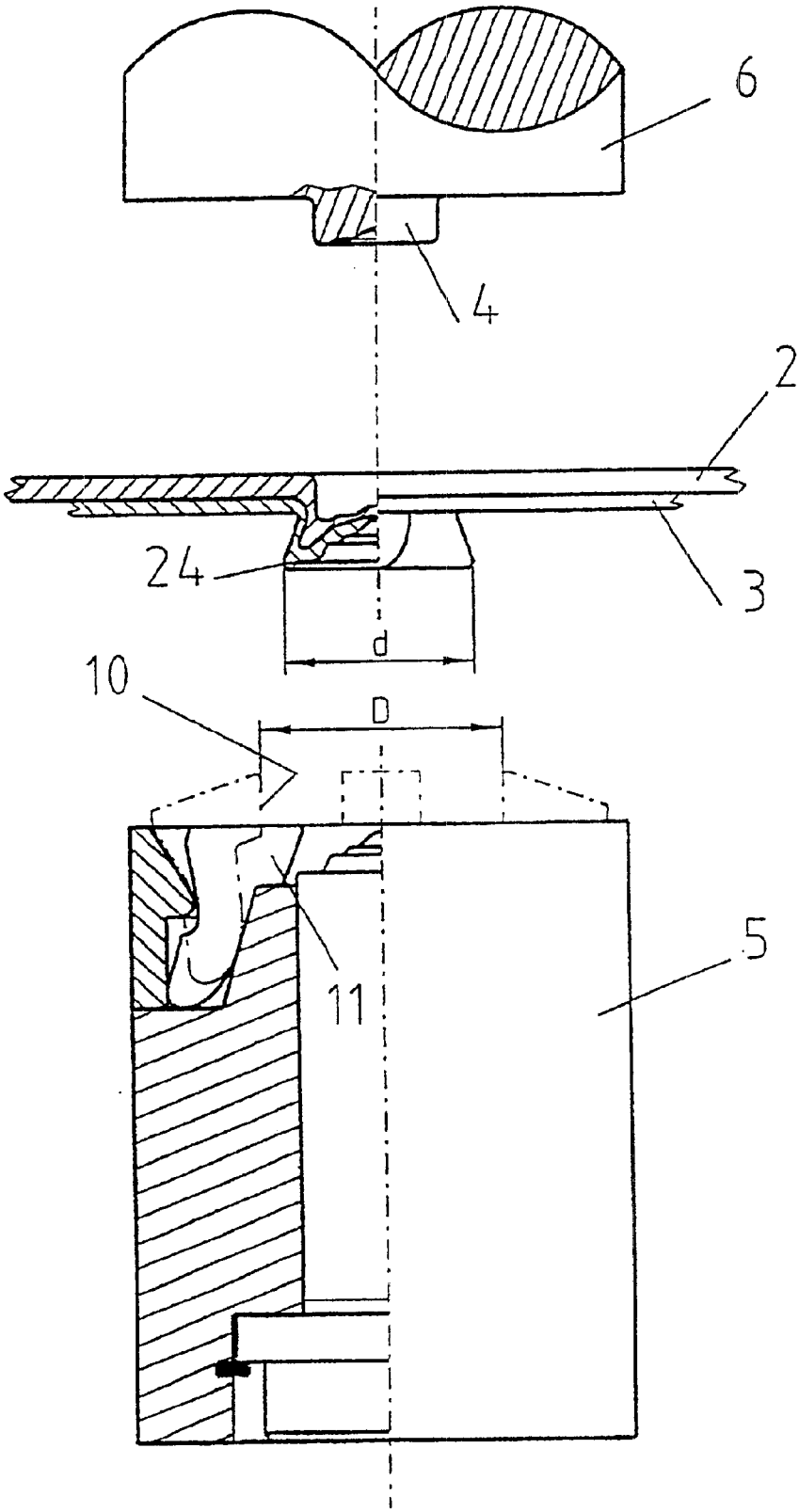
FIG. 8 the device according to FIG. 7 in an exploded view.

In FIG. 8 the lever 11 is shown in solid lines in the working position and in dashed lines in the release position. This shows that the movement of the lever 11 is no longer a pure pivot movement. The lever 11 is instead also lifted when position changes occur. The upper side of the nose 27 in this context forms a gliding surface on which a corresponding counter surface of the notch 28 will glide. The lower end of the notch 28 however is caught in the release position at the lower end of the nose 27 thus preventing a further movement.

As can be seen in FIG. 8, the wall sections 10 of the levers 11 in the extended position, i.e., in the release position, are vertical. They release in this position a diameter D which is greater than the greatest diameter d of the undercut areas 24 on the workpiece 3. It is thus possible without a problem to lift the workpieces 2, 3 out of the die 5.

The wall 26 is formed here as a separate part which can be mounted and demounted within the die 5. For exchanging the levers 11, the wall 26 must be briefly removed.

Figure 10:
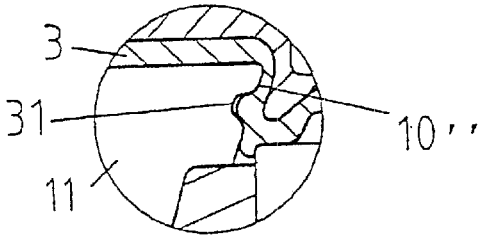
FIG. 10 a further alternative corresponding to FIG. 8.

FIGS. 9 and 10 show that the movable wall part 10' must not necessarily be formed by a planar surface. In the embodiment according to FIG. 9 the lever 11 is provided with a wall section 10' which is formed at its upper end by a slanted plane, as already shown in FIGS. 1, 4, and 7. Below this portion a cavity 29 is present which provides an even larger space for the penetration of the material of the lower workpiece 3. Illustrated is the state of deformation. The thin line 30 is provided to illustrate to which extent the material of the workpiece 3 can still penetrate into the cavity 29.

FIG. 10 shows an embodiment of a wall section 10" wherein within the slanted surface a groove 31 is provided which also provides a space into which the material of the workpiece 3 and also, of course, the material of the workpiece 2 can subsequently flow.

In both cases the only condition is that in the release position the levers have pivoted far enough into the open position in order to be able to remove the undercut areas 24 of the connection out of the die.

FIG. 11 shows in four representations the process during removal, i.e., the working step during which the plunger is moved away from the die and the levers release the workpiece or the workpiece pair.

Figure 11D:
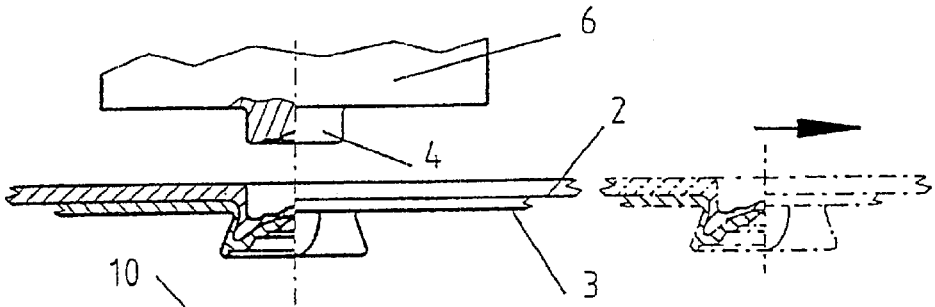
FIG. 11 an illustration of the course of movement during removal of the connected workpieces from the device.
Figure 11D:
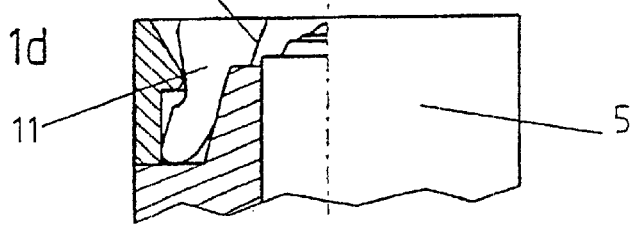
Figure 11C:
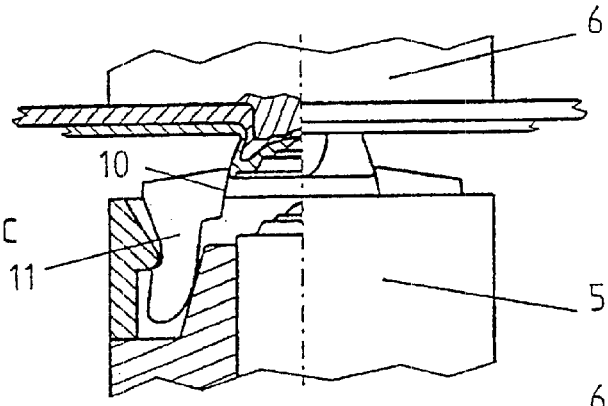
Figure 11B:
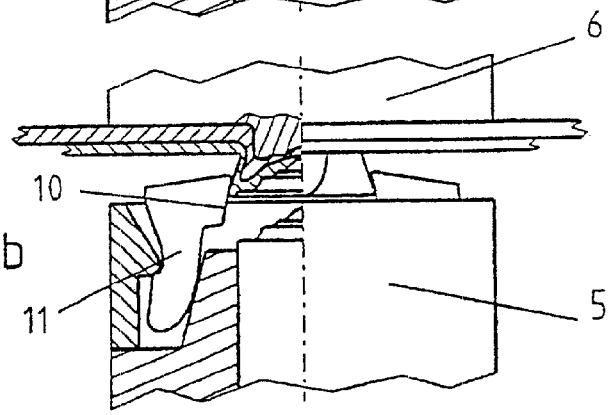
Figure 11A:
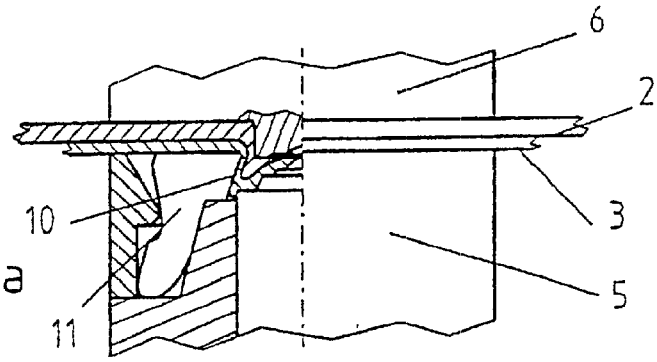

FIG. 11*a* shows the starting point. It can be seen that the clinching connection has been produced. The lever 11 forms with its slanted wall section 10 an undercut into which the material of the lower workpiece 3 has flowed. In FIG. 11*b* it is shown that the plunger support 6 has lifted off the die 5. As a result of the relatively great friction between the plunger 4 and the workpiece 2, the plunger 4 entrains the workpiece pair 2, 3. The undercut area of the clinching connection however is not yet released from the slanted wall 10 but lifts the lever 11 which is thus moved outwardly via pivot movement. The movement of the plunger support 6 is continued until, as illustrated in FIG. 11*c*, the clinching connection reaches the upper limiting edge of the wall section 10. At this point, the lever 11 has been pivoted farthest outwardly. When the workpiece pair 2, 3 is moved father upwardly, the clinching connection, more precisely, their formed parts, will become free of the wall 10 and the lever 11 can then fall again downwardly into the die 5, as illustrated in FIG. 11*d*. Here it is also illustrated that the workpiece pair 2, 3 has in the meantime been released by the die 4 for which purpose, as is known, machine elements such as holding-down means or similar means can be used. The workpiece pair can then be removed laterally as is illustrated by dashed lines.

While in the device as presented above only one clinching connection between the two workpieces 2, 3 is provided, FIGS. 12 through 14 show devices with which successively, i.e., serially, a series of clinching connections can be produced. FIG. 12 shows for example a device in which several plungers 4 are arranged on plunger supports wherein the plunger supports 6 are arranged on a first wheel 50 which can be rotated about an rotational axis 52 in the direction of arrow 51. The plunger support 6 and the plunger 4 in this case are located underneath the pair of workpieces 2, 3 so that the formed portion resulting from the clinching process is produced on the top side of the workpiece 3. FIG. 12*c* shows the wheel 15 in a plan view, partially in section. The plungers 4 at the top side can be seen. The wheel 50 can be secured between two clamping flanges 53, 54 which are, in turn, supported on a shaft 55 wherein the shaft 55 is of a relatively massive configuration in order to be able to receive the required pressing forces.

Figure 12B:
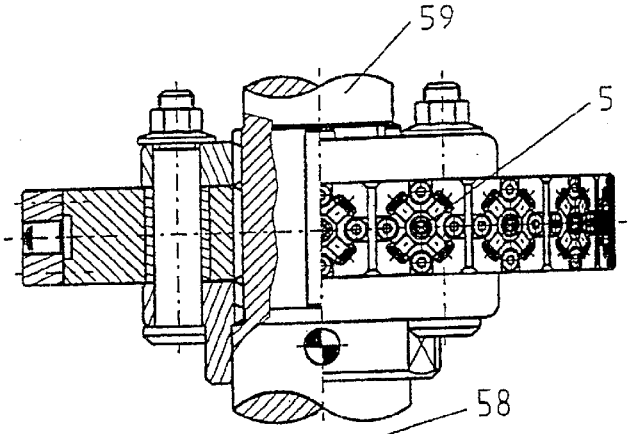
FIG. 12 a device for sequential generation of several clinching connections.

In a similar way the dies 5 are arranged on a peripheral surface of a second wheel 56 which can be rotated about a rotational axis 58 in the direction of arrow 57. The rotational axis 58 is also formed by a relatively massive shaft 59 as can be seen in FIG. 12*b*.

The peripheral speeds of the two wheels 50, 56 are identical so that neighboring plungers 4 can penetrate sequentially neighboring dies 5. This provides a sequence of clinching connections between the two workpieces 2, 3.

Figure 12A:
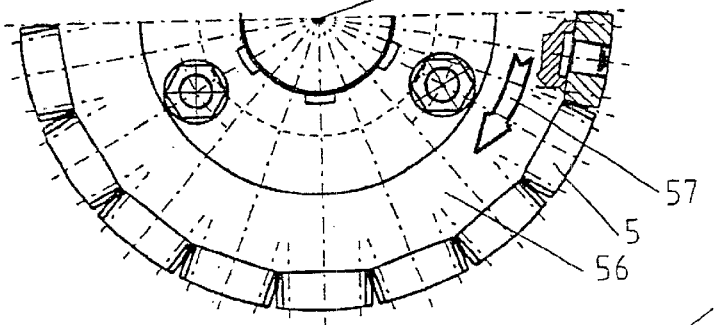
Figure 12A:
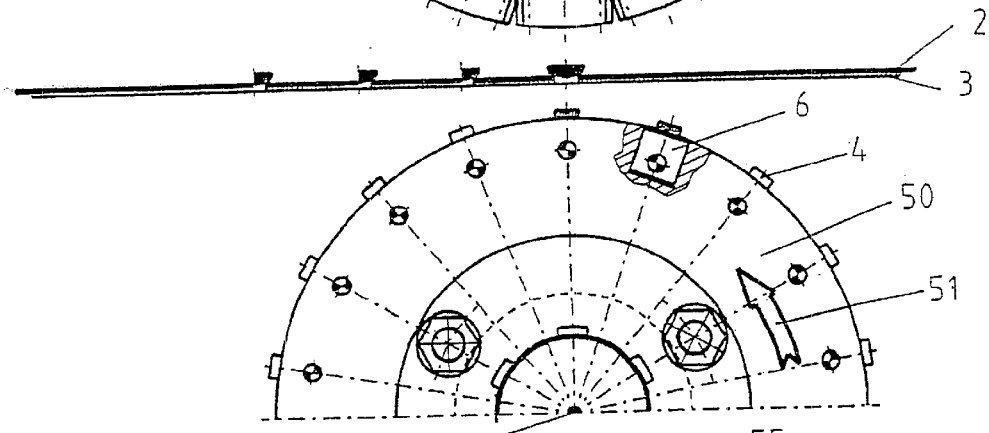
Figure 12C:
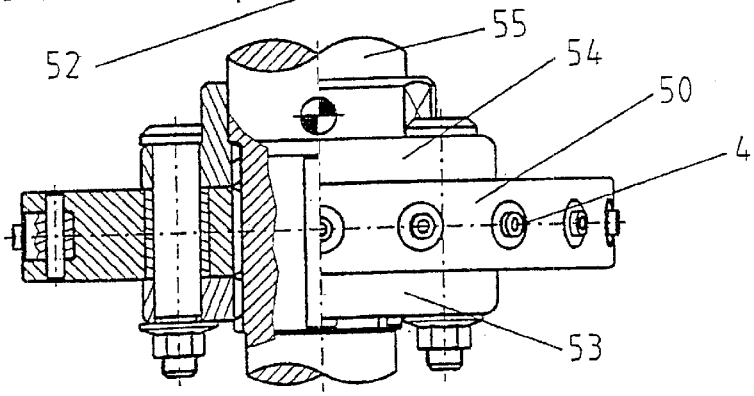

FIG. 12*a* hows that the dies 5 are arranged in modules which are fastened on the peripheral surface of the wheel 56. This facilitates manufacture. The peripheral surface of the wheel 56 has a number of dies 5 corresponding to the number of flat portions.

Figures 13A, 13B:
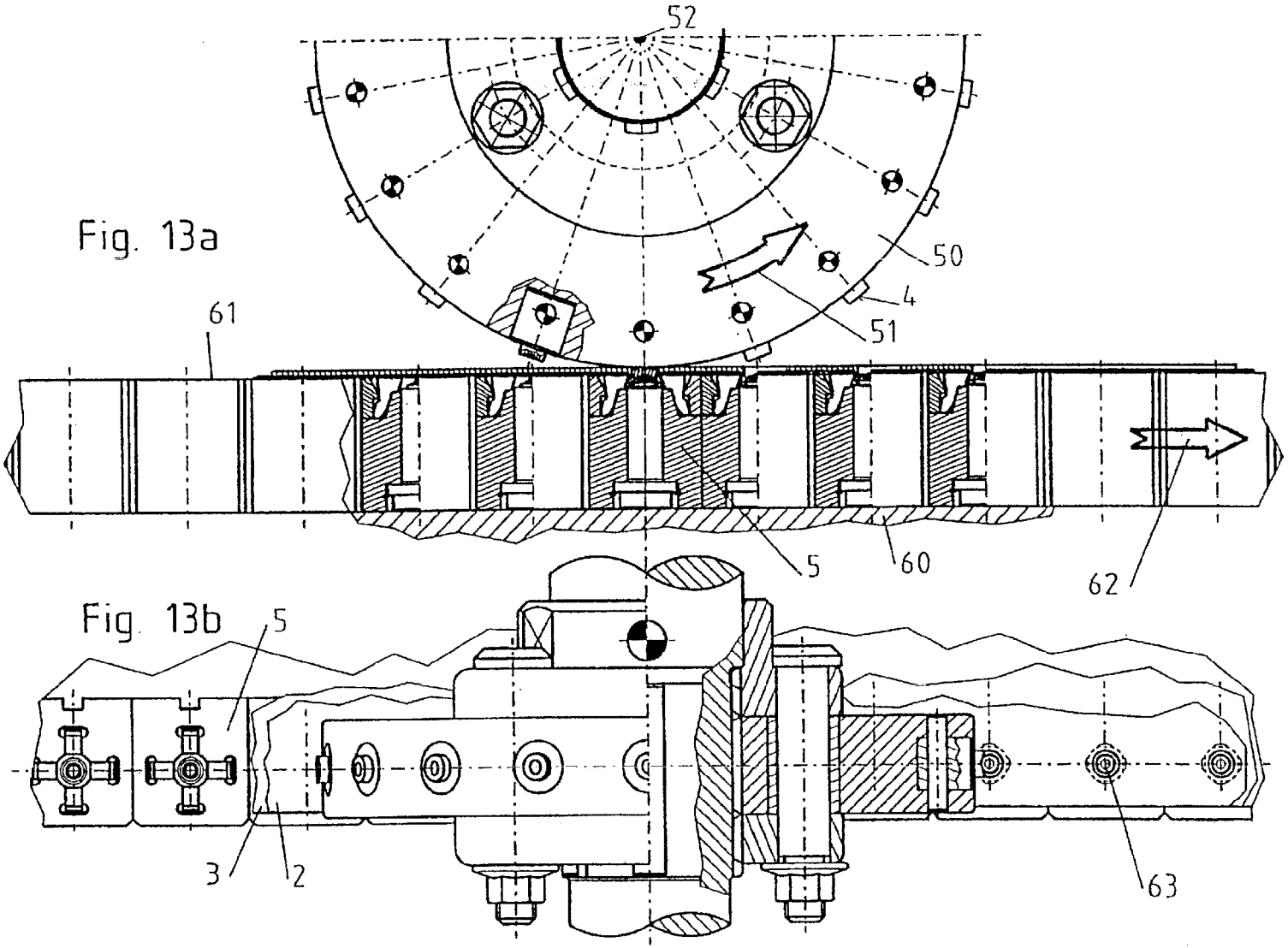
FIG. 13 a device variation changed relative to FIG. 12.

FIG. 13 shows a somewhat changed embodiment. The plungers 4 are still arranged on a wheel 50 which rotates about axis 52 in the direction of arrow 51. The dies 5 are however arranged on the support 60 which has a substantially planar surface 61. When the wheel 50 is rotated in the direction of arrow 51, the support 60 is synchronously moved in the direction of arrow 62, i.e., the peripheral speed of the wheel 50 coincides with the advancing speed of the support 60. This also makes it possible to move the individual plungers 4 successively into the corresponding dies 5. FIG. 13*a* shows a side view, partially in elevation. FIG. 13*b* shows a plan view wherein in the left part the workpieces 2, 3 are partially removed in order to allow a view onto the dies 5 while in the right half the clinching connections 63 can be seen in a plan view. By means of a dashed line it is illustrated that the clinching connections 63 have a quadrangular shape as a result of the undercut areas at the underside of the workpiece 3.

Figures 14A, 14B:
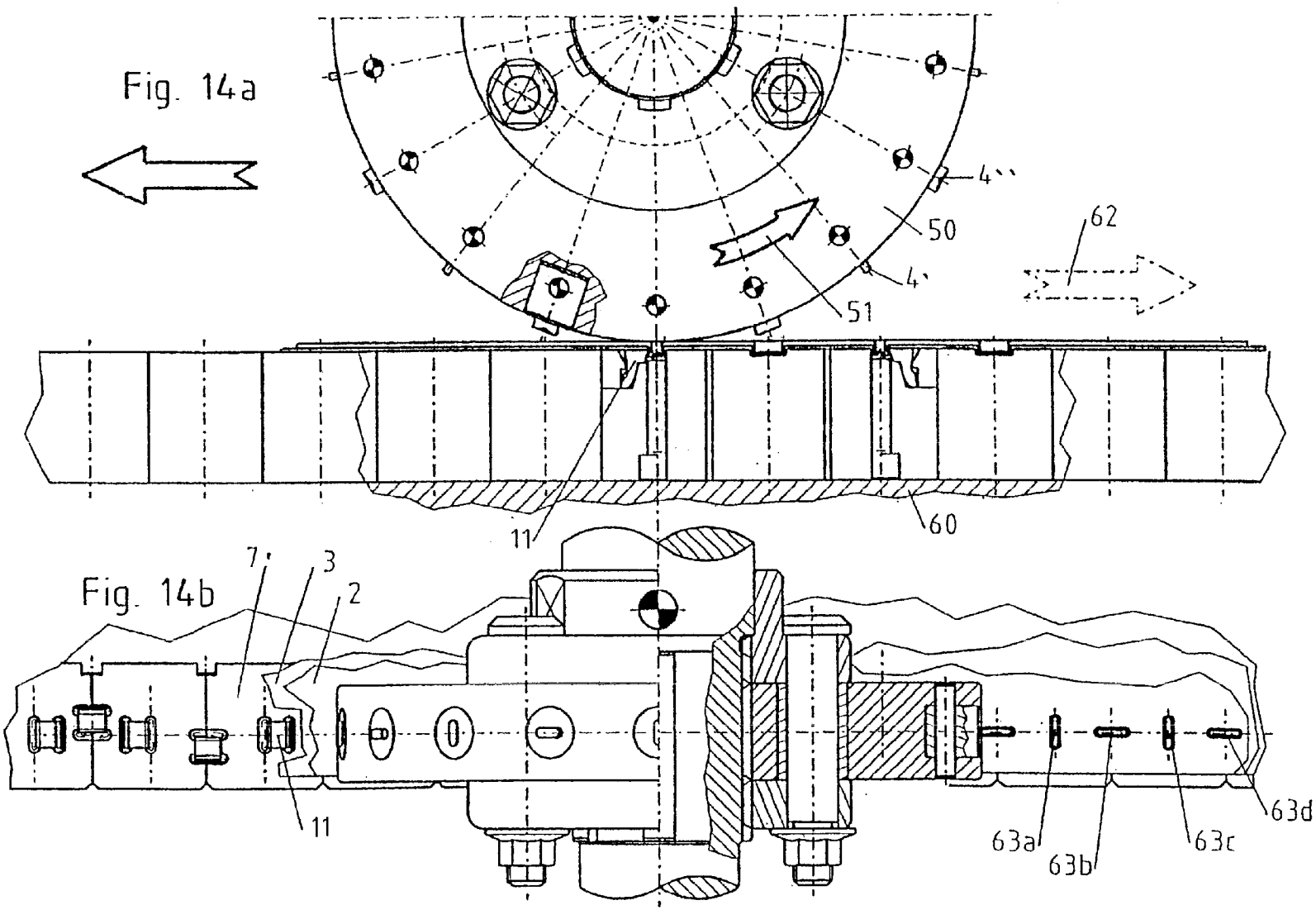
FIG. 14 a further embodiment of such a device.

FIG. 14 shows a further changed embodiment of FIG. 13. FIG. 14*a* shows the device in a side view, and FIG. 14*b* shows the device in a plan view, partially in section, partially with an partially without workpieces.

It should be noted first that the dies which can be seen in the left half of FIG. 14*b* have only one lever 11. The corresponding recess 7' is thus slot-shaped. The recess 7' is no longer of radial symmetry, as in the previously described recesses 7, but is asymmetric. Neighboring recesses are rotated respectively by 90° relative to one another so that, as can be seen in the right half of FIG. 14*b*, clinching connections 63*a*, 63*b*, 63*c*, 63*d* result which are staggered relative to one another. Also, the plungers 4' are matched to the recesses 7'. They are no longer symmetrical but instead long and narrow. Neighboring plungers 4', 4" are rotated by 90° relative to one another.

The end faces and outer boundaries of the plunger arrangements 4" in the rolling direction are corrected with regard to their shape according to the laws of an involute gear system in order to ensure optimal rolling. This provides a rolling process which is comparable to the movement of the gear on a toothed rack or on another gear.

What is claimed is:

1. Clinching device for generating a clinching connection between a first workpiece and a second workpiece by means of a plunger which is movable from above into a recess (7) of a die, wherein a peripheral wall of the recess has stationary wall sections (8) which extend essentially parallel to a pressure direction, wherein the peripheral wall of the recess (7) has movable wall sections (10,10',10") between the stationary wall sections (8), wherein the movable sections are arranged on levers (11), wherein the levers (11) are movable by pressure from above into a working position and are securable therein and form undercut areas (12) and are movable by a movement of the workpieces (2, 3) in the upward direction after the workpieces have been jointed into a release position in which the undercut areas (12) are completely released.

2. Device according to claim 1, wherein the levers (11) have a substantially planar top side (14) which in the working position is perpendicularly arranged relative to the pressure direction (9) and is positioned in a common plane with the top side of the die (5).

3. Device according to claim 1 or 2, characterized in that each lever (11) is an angled lever.

4. Device according to claim 3, characterized in that the angled lever has a short arm on which the wall section (10) is arranged and a long arm on which a pivot axis (13, 27) is provided.

5. Device according to claim 1, wherein at least three levers (11) are distributed in the peripheral direction of the recess (7).

6. Device according to claim 5, characterized in that four levers (11) are provided.

7. Device according to one of the claims 1 to 6, characterized in that the stationary wall sections (8) form at least 50% of the peripheral length of the recess (7).

8. Device according to one of the claims 1 to 7, characterized in that the die (5) has for each lever a securing device (13, 27) against falling out.

9. Device according to claim 8, characterized in that the securing device against falling out is a nose (27) which is oriented radially in the direction toward the lever (11), wherein the lever has a notch (28) cooperating with the nose (27).

10. Device according to claim 9, characterized in that the nose (27) has at its upper side a guide surface on which the lever (11) glides upon movement.

11. Device according to claim 9 or 10, characterized in that the nose (27) is formed on an insert part (26).

12. Device according to claim 8, characterized in that the securing device against falling out is a pin (13) which is guided through the die (5) and the lever (11) and forms a pivot axis.

13. Device according to one of the claims 1 to 12, characterized in that the recess (7) has a bottom (17) which is arranged at the upper side of a bottom part (18) inserted into the die (5).

14. Device according to claim 1, wherein several dies (5) are arranged on a first support (56, 60) adjacent to one another and several plungers (4, 4', 4") are arranged on a second support (50) adjacent to one another with equal division, wherein at least one of the [two] supports (56, 60) is movable relative to another of the supports (50) such that the plungers (4, 4', 4") and dies (5) successively engage one another.

15. Device according to claim 14, characterized in that at least one support (50) is a wheel and the other support (60) is formed with a planar surface (61).

16. Device according to claim 14, characterized in that the two supports (50, 56) are formed as a wheel.

17. Device according to one of the claims 14 to 16, characterized in that adjacently positioned dies (5) have differently designed lever arrangements.

18. Device according to claim 17, characterized in that the lever arrangements are arranged asymmetrically wherein the lever arrangements of neighboring recesses (7') are rotated relative to one another.

19. Device according to claim 18, characterized in that for each recess (7') only one lever is provided.

20. Die with a recess (7) in an end face, wherein a peripheral wall of the recess has stationary wall sections (8) which extend substantially parallel to the longitudinal axis of the die, wherein the peripheral wall of the recess (7) has movable wall sections (10,10',10") between the stationary wall sections (8), wherein the movable sections are arranged on levers (11), wherein the levers (11) are movable by pressure on the end face into a working position and are securable therein and form undercut areas (12) and are movable by a pivot movement, respectively, a movement in the upward direction into a release position in which the undercut areas (12) are completely released.

21. Die with a body having a longitudinal axis, comprising a recess (7) in an end face of the body and with at least one lever which in a working position forms an undercut wall section of the recess and is pivotably arranged in a receptacle in the body of the die, wherein the lever in the working position is secured by pressure on a pressure surface at the end face of the die, but is moveable by a pivot movement into a release position.

22. Use of a die according to claim 20, in order to attach an auxiliary connecting part to a workpiece.

23. Die according to claim 20, wherein the die comprises a lowerable plunger which can be lowered to such an extent that it releases an opening to a supply path for an auxiliary connecting part.

24. Use of a die according to claim 21, in order to attach an auxiliary connecting part to a workpiece.

25. Die according to claim 21, wherein the die comprises a lowerable plunger which can be lowered to such an extent that it releases an opening to a supply path for an auxiliary connecting part.

* * * * *